US011154879B2

(12) United States Patent
Kim et al.

(10) Patent No.: US 11,154,879 B2
(45) Date of Patent: Oct. 26, 2021

(54) ORIFICE AND SPRAY CONTAINER INCLUDING THE SAME

(71) Applicant: YONWOO CO., LTD., Incheon (KR)

(72) Inventors: Sang Hyung Kim, Incheon (KR); Hun Bong, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 16/980,236

(22) PCT Filed: Jan. 28, 2019

(86) PCT No.: PCT/KR2019/001174
§ 371 (c)(1),
(2) Date: Sep. 11, 2020

(87) PCT Pub. No.: WO2019/177267
PCT Pub. Date: Sep. 19, 2019

(65) Prior Publication Data

US 2021/0252529 A1 Aug. 19, 2021

(30) Foreign Application Priority Data

Mar. 15, 2018 (KR) ..... 10-2018-0030271

(51) Int. Cl.
*B05B 1/34* (2006.01)
*B05B 11/00* (2006.01)

(52) U.S. Cl.
CPC ..... *B05B 1/34* (2013.01); *B05B 11/3001* (2013.01); *B05B 11/305* (2013.01); *B05B 11/3067* (2013.01)

(58) Field of Classification Search
CPC ..... B05B 1/34; B05B 11/3001; B05B 11/305; B05B 11/3067; B05B 1/3436; B05B 1/3431; B05B 1/341; B65D 47/243
See application file for complete search history.

(56) References Cited

U.S. PATENT DOCUMENTS 3,680,793 A * 8/1972 Tate ..... B05B 1/3436 239/468
4,260,110 A * 4/1981 Werding ..... B05B 1/3436 239/404

(Continued)

FOREIGN PATENT DOCUMENTS

JP 2000-153188 A 6/2000
JP 2011-147920 A 8/2011

(Continued)

*Primary Examiner* — Vishal Pancholi
*Assistant Examiner* — Bob Zadeh
(74) *Attorney, Agent, or Firm* — Novick, Kim & Lee, PLLC; Sang Ho Lee; Hyun Woo Shin

(57) ABSTRACT

Provided is an orifice and a spray container including the same. The orifice, which is provided at an outlet of the spray container, includes: an inflow part formed in a hollow cylindrical shape into which a nozzle is inserted and configured to receive contents flowing in through a circumference of the nozzle; a ring part recessed to a predetermined depth in a discharge direction from a circumference of a front surface of the inflow part; a discharge path provided at a center of the ring part and having a cross-sectional area decreasing in a direction toward a front; a wing part extending from the ring part toward the discharge path; and a discharge port provided at a front end of the discharge path.

9 Claims, 14 Drawing Sheets

(56) References Cited

U.S. PATENT DOCUMENTS

| | | | | | |
|---|---|---|---|---|---|
| 4,706,888 | A * | 11/1987 | Dobbs | B05B 1/3436 | 239/478 |
| 4,941,595 | A * | 7/1990 | Montaner | B05B 11/3016 | 222/321.2 |
| 5,722,598 | A * | 3/1998 | Werding | B05B 1/3405 | 239/403 |
| 6,186,417 | B1 * | 2/2001 | Ho | B05B 1/3436 | 239/491 |
| 6,241,165 | B1 * | 6/2001 | Bickart | B05B 1/3436 | 239/463 |
| 6,793,156 | B2 * | 9/2004 | Dobbs | B05B 1/3436 | 239/492 |
| 7,886,995 | B2 * | 2/2011 | Togashi | B65D 83/20 | 239/463 |
| 2013/0087638 | A1 * | 4/2013 | Miyamoto | B05B 1/341 | 239/490 |
| 2017/0001205 | A1 * | 1/2017 | Monton | B05B 15/18 | |

FOREIGN PATENT DOCUMENTS

| | | | |
|---|---|---|---|
| KR | 10-2000-0049441 | A | 8/2000 |
| KR | 10-0692457 | B1 | 3/2007 |
| KR | 10-2016-0111165 | A | 9/2016 |
| KR | 10-1661575 | B | 10/2016 |
| KR | 10-2018-0025769 | A | 3/2018 |

* cited by examiner

ORIFICE AND SPRAY CONTAINER INCLUDING THE SAME

TECHNICAL FIELD

The present invention relates to an orifice and a spray container including the same, and more particularly, to an orifice and a spray container including the same capable of securing a sufficient spray distance and reducing the size of spray particles.

BACKGROUND ART

Generally, spray containers spray liquid contents stored therein in an aerosol form when a user presses a spray button and are widely used for spraying a cosmetic liquid, a medicinal liquid, or the like.

Among the spray containers, a spray container disclosed in Related Art Document 1 below includes a suction port in addition to a tube, a tube case, which includes a ball configured to regulate the suction port, and a double suction device, which is formed of an inner case and the tube. In this way, the spray container disclosed in Related Art Document 1 has advantages in that spraying is possible even in a state in which the spray container is placed upside down, and, by adopting a method in which shapes of a secondary valve and a housing are improved so that the two components are always in contact, degradation in spraying performance due to deformation of the secondary valve, which occurs during a spraying operation using a conventional spray device, is prevented.

However, in the spray container according to Related Art Document 1, in a process in which a button is pressed and liquid contents stored therein are sprayed through a nozzle, there is no separate numerical value or shape assigned to the structure of a discharge hole portion.

Therefore, in Related Art Document 1, there is a problem in that, since a spray angle, which is the most important factor among factors of the spray container, is not optimally formed according to the purpose of use, it is not possible to provide the best spraying performance for each body part of the user.

In order to address such a problem, the applicant of the present invention has filed an application for a patent for Related Art Document 2 and has been granted the patent. Related Art Document 2 discloses a spray container that sprays liquid contents on the face, head, upper body, lower body, or the like of a user. By manufacturing an optimal spray orifice in consideration of a spray angle, at which liquid contents are sprayed, for each body part, differentiated spraying performance may be provided for each body part of the user.

However, in the case of Related Art Document 2, due to a limitation that, as in the conventional cases, sprayed particles are not able to be formed in a fine size, there is a possibility that droplets may be generated on a spray hole. In this case, there is a problem in that the droplets may cause the user to mistakenly perceive that the contents have leaked and a failure has occurred.

Related Art Document 1: Korean Unexamined Patent Application Publication No. 2000-0049441

Related Art Document 2: Korean Patent Registration No. 10-1661575

DISCLOSURE

Technical Problem

The present invention is directed to providing an orifice and a spray container including the same capable of increasing a spray distance and decreasing a spray angle while increasing a discharge amount so that efficient spraying is possible.

The present invention is also directed to providing an orifice and a spray container including the same capable of reducing a particle size of a sprayed material so that a waste of contents is prevented and user satisfaction is improved.

Technical Solution

One aspect of the present invention provides an orifice provided at an outlet of a spray container, the orifice including: an inflow part formed in a hollow cylindrical shape into which a nozzle is inserted and configured to receive contents flowing in through a circumference of the nozzle; a ring part recessed to a predetermined depth in a discharge direction from a circumference of a front surface of the inflow part; a discharge path provided at a center of the ring part and having a cross-sectional area gradually decreasing toward a front; a wing part extending from the ring part toward the discharge path; and a discharge port provided at a front end of the discharge path.

Specifically, the wing part may extend from the ring part so as to come in contact with a circumference of the discharge path.

Specifically, the wing part may have a shape in which a cross-sectional area decreases in a direction from one end connected to the ring part to the other end connected to the discharge path.

Specifically, the discharge port may include a flat rear surface.

Specifically, a cross-sectional area of the discharge port may be smaller than a cross-sectional area of the inflow part and larger than the cross-sectional area of the discharge path.

Specifically, the discharge port may have a shape in which a circumferential surface is bent as compared to the rear surface.

Specifically, the discharge port may be provided in a cylindrical shape.

Specifically, the discharge path may include: a large-diameter part in which a cross-sectional area is constant in a front-rear direction and the wing part is connected to a circumference; a shaft tube part which has a gradually-decreasing cross-sectional area while extending from the large-diameter part to a front end; and a small-diameter part in which a cross-sectional area is constant in the front-rear direction and which is connected to the front end of the shaft tube part and connected to the discharge port.

One aspect of the present invention provides a spray container including: a container main body, of which one side is open, configured to accommodate contents; a screw cap coupled to the open one side of the container main body; a housing provided at an inner side of the screw cap and having a suction port formed at a lower end; a cylinder configured to move up and down inside the housing and having an inlet port formed at one side; a seal cap configured to move up and down inside the housing and open or close the inlet port while being pressed against an inner wall of the housing; and a button having an outlet, at which an orifice according to any one of claims 1 to 8 is provided, and configured to be pressed and cause the cylinder to move downward. Specifically, the spray container may further include: a stem connecting the cylinder and the button and configured to move up and down together with the cylinder while being pressed against the inner wall of the housing; an under-cap coupled to the screw cap or the housing and wrapping around the stem; a first elastic member provided between the cylinder and the housing and having an elastic force that causes the cylinder to move upward; and a second elastic member provided between the stem and the seal cap and having an elastic force that causes the seal cap to move downward with respect to the stem.

Advantageous Effects

An orifice and a spray container including the same according to the present invention can spray a material far away at a narrow angle and can spray the material as fine particles because a particle size of the material is very small. Therefore, usability can be significantly improved.

In addition, the orifice and spray container including the same according to the present invention can minimize the generation of droplets and thus address a problem in that the droplets cause a user to mistakenly perceive that leakage of the material has occurred.

MODES OF THE INVENTION

Figure 1:
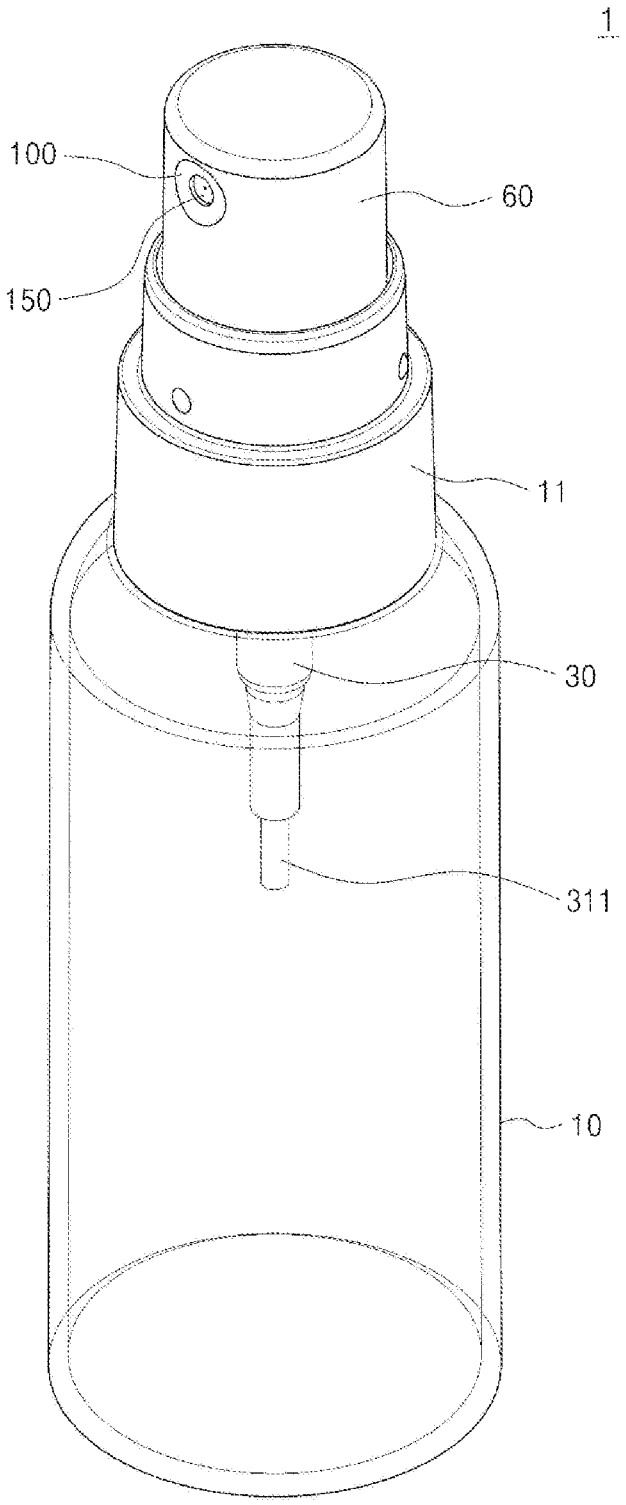
FIG. 1 is a perspective view of a spray container according to an embodiment of the present invention.

The objectives, specific advantages, and novel features of the present invention will become more clear from the detailed description below and exemplary embodiments relating to the accompanying drawings. In the present specification, in giving reference numerals to elements in each drawing, it should be noted that like reference numerals are given to like elements as much as possible even when the elements are illustrated in different drawings. In addition, in describing the present invention, when detailed description of a known related art is deemed to unnecessarily obscure the gist of the present invention, the detailed description thereof will be omitted.

Hereinafter, exemplary embodiments of the present invention will be described with reference to the accompanying drawings. For reference, in the present specification, "front-rear direction" is based on a discharge direction of contents, and other directions will be described on the basis of the drawings, but the scope of the present invention is not limited thereto.

Figure 2:
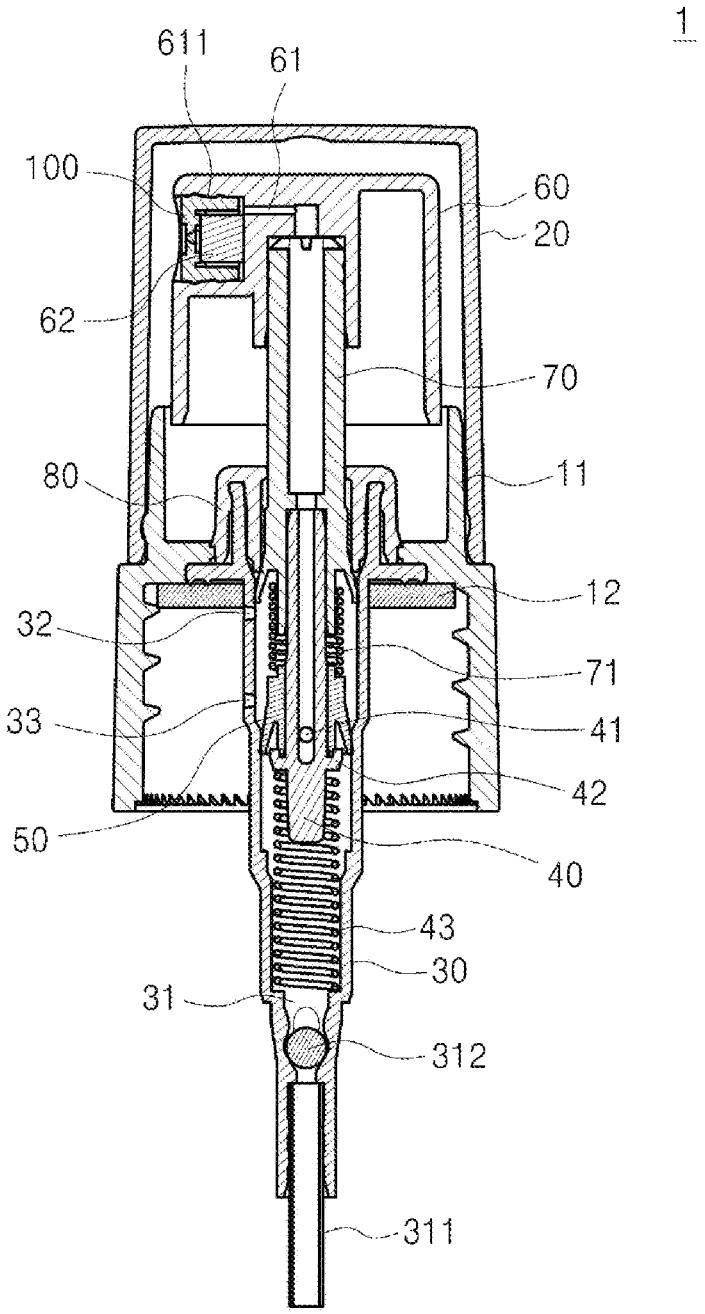
FIG. 2 is a cross-sectional view of the spray container according to an embodiment of the present invention.
Figure 3:
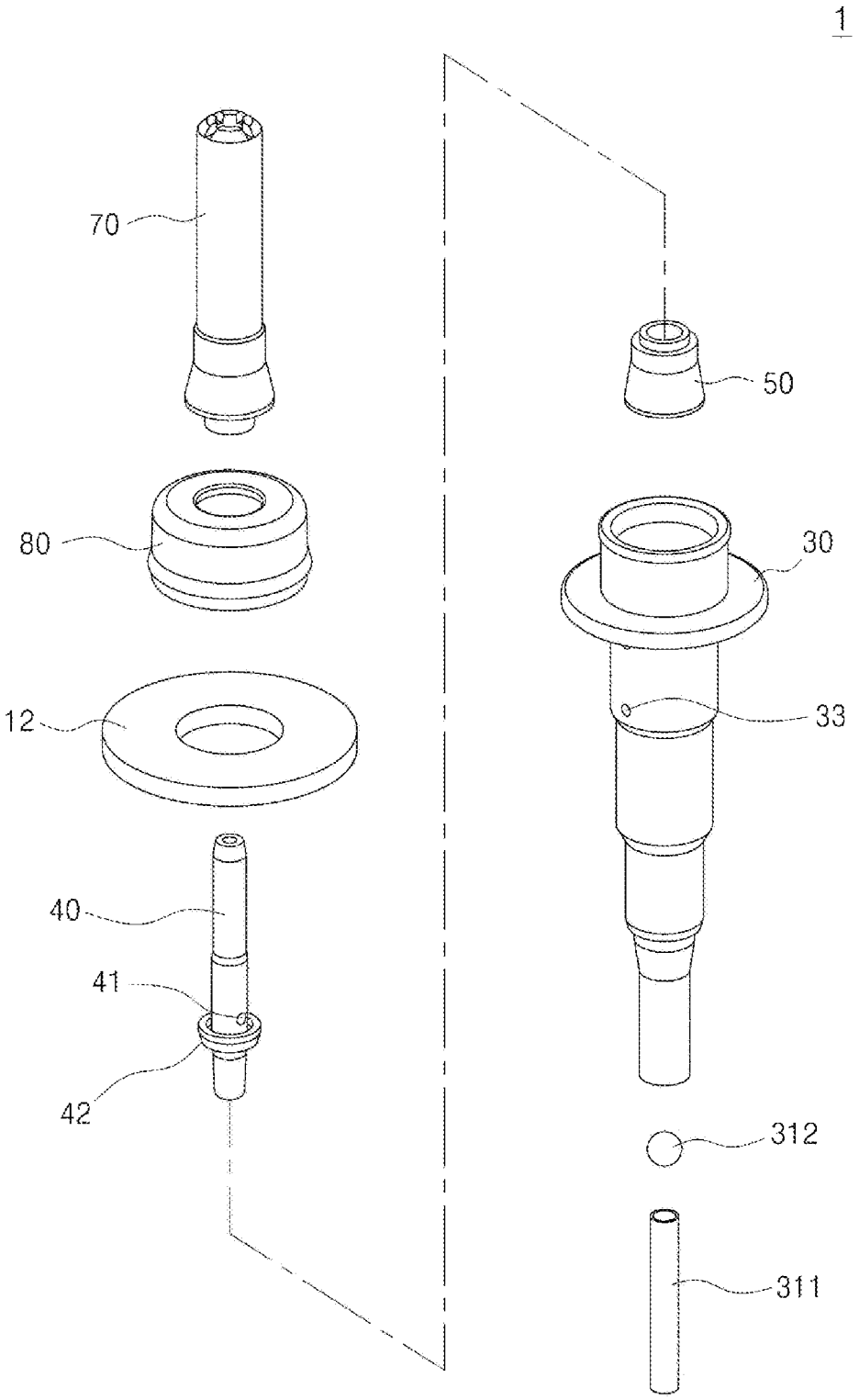
FIG. 3 is an exploded perspective view of a portion of the spray container according to an embodiment of the present invention.
Figure 4:
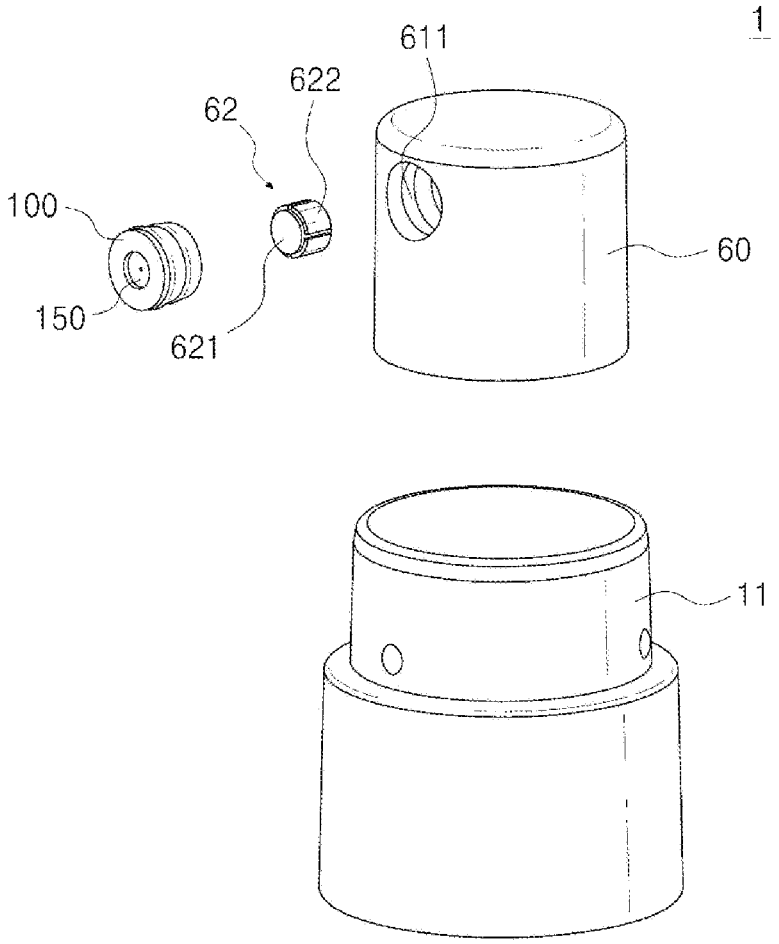
FIG. 4 is an exploded perspective view of a portion of the spray container according to an embodiment of the present invention.

FIG. 1 is a perspective view of a spray container according to an embodiment of the present invention, and FIG. 2 is a cross-sectional view of the spray container according to an embodiment of the present invention. FIGS. 3 and 4 are exploded perspective views of a portion of the spray container according to an embodiment of the present invention.

Referring to FIGS. 1 to 3, a spray container 1 according to an embodiment of the present invention includes a container main body 10, a screw cap 11, an over-cap 20, a housing 30, a cylinder 40, a seal cap 50, a button 60, a stem 70, an under-cap 80, and an orifice 100.

The container main body 10 accommodates contents and has a shape of which one side is open. Here, the contents accommodated in the container main body 10 refer to all kinds of material that may be sprayed in an aerosol form. For example, the contents may be a cosmetic liquid.

A material of which the container main body 10 is made is not particularly limited. The container main body 10 may be made of a hard material such as a synthetic resin and metal. Also, at least a portion of the container main body 10 may be formed to be transparent or translucent so that a residual amount of contents may be checked from the outside.

An upper side of the container main body 10 may be open and protrude upward in the shape of a mouth. Here, the screw cap 11, which will be described below, may be coupled to the open one side, and thus an inner portion of the container main body 10 may be sealed.

Screw threads (not denoted by a reference numeral) may be provided at an outer surface of the mouth of the container main body 10 and may also be provided at an inner surface of the screw cap 11 so that the screw cap 11 and the container main body 10 may be fastened or separated by a screw-coupling method.

The screw cap 11 is coupled to the open one side of the container main body 10. As mentioned above, the screw cap 11 may be fastened to the container main body 10 by a screw-coupling method or the like, and a fastening portion between the screw cap 11 and the container main body 10 may be sealed to prevent leakage.

The screw cap 11 has a hollow shape, and the housing 30, which will be described below, is provided in a hollow central portion of the screw cap 11. The housing 30 may be coupled to the screw cap 11 or integrally provided with the screw cap 11.

Also, the under-cap 80 may be provided in the hollow central portion of the screw cap 11. The under-cap 80 is a configuration that is coupled to an upper side of the housing 30 and wraps around the stem 70 to prevent leakage. The under-cap 80 will be described in detail below.

A gasket 12 may be provided at an inner upper end of the screw cap 11. The gasket 12 may be a ring-shaped sealing part having a predetermined thickness. The gasket 12 may be made of a compressible material such as a synthetic resin.

In a case in which the screw cap 11 is fastened to the mouth of the container main body 10, the gasket 12 may be provided to be compressed between the screw cap 11 and the container main body 10. Also, the gasket 12 may be provided to wrap around the housing 30, which is provided in the center of the screw cap 11, so that an upper surface of the gasket 12 comes in contact with the housing 30. Therefore, sealing between the screw cap 11 and the container main body 10 and sealing between the screw cap 11 and the housing 30 may be implemented by the gasket 12.

The over-cap 20 is coupled to the screw cap 11 and covers the button 60. The over-cap 20 may have a height higher than that of the button 60 raised to its maximum height and thus may prevent the button 60 from being pressed when the over-cap 20 is coupled.

A protrusion (not denoted by a reference numeral) may be provided at an outer surface of the screw cap 11, and the over-cap 20 may be fastened to the screw cap 11 by a method of coupling a protrusion and a groove. Of course, a method of coupling the over-cap 20 and the screw cap 11 is not particularly limited.

The housing 30 is provided inside the screw cap 11, and a suction port 31 is formed at a lower end of the housing 30. The housing 30 may be provided in the hollow central portion of the screw cap 11, and the screw cap 11 and the housing 30 may be connected to each other by various methods such as a screw-coupling method, a forcibly-fitting method, and adhesion.

Also, since the gasket 12 is pressed against a lower surface of a point where the housing 30 and the screw cap 11 are connected, sealing around the housing 30 may be implemented by the gasket 12.

The housing 30 may have a hollow shape and have a shape in which an inner diameter decreases in stages in a direction from an upper side to a lower side. The stem 70 may be provided to move up and down at an upper portion of the housing 30 where the inner diameter is large, and the cylinder 40 may be provided to move up and down at a lower portion of the housing 30 where the inner diameter is small.

In the housing 30, one or more step portions where the inner diameter decreases may be provided to block downward movement of the stem 70 or the seal cap 50 or may allow a lower end of a first elastic member 43, which will be described below, to be seated thereon.

The suction port 31 is provided at the lower end of the housing 30, and the inner portion of the housing 30 may communicate with the container main body 10 through the suction port 31. Here, a tube 311 may extend downward from the suction port 31. The tube 311 is provided to pump the contents stored on a floor of the container main body 10 upward.

A ball 312 is provided in the vicinity of the suction port 31. The ball 312 may be disposed above the tube 311. In the housing 30, a portion where the ball 312 is provided may have a shape that allows the ball 312 to move up and down due to a pressure difference. In this case, when the ball 312 moves upward, the inner portion of the housing 30 may communicate with the container main body 10, and, when the ball 312 moves downward, the inner portion of the housing 30 and the container main body 10 may be isolated.

That is, the ball 312 may implement a function of a valve, but, of course, various configurations other than the ball 312 may also be used to implement the function of a valve. Also, the tube 311 may be omitted. For example, in the case of an airless configuration in which a pressing plate is provided in the container main body 10 so as to move upward as the contents are used, the tube 311 may not be provided.

A first hole 32 and a second hole 33 may be formed at an outer side of the housing 30. The first hole 32 may be provided to pass through an upper-side wall of the housing 30 and may be a configuration that allows air that entered through a gap between the under-cap 80 and the stem 70 during discharge of contents to enter the container main body 10.

The second hole 33 may be provided to communicate with a space between the stem 70 and the seal cap 50, each of which is pressed against the inner wall of the housing 30. When the seal cap 50 moves downward due to a second elastic member 71, which will be described below, during downward movement of the stem 70, a pressure in an inner space of the housing 30 (particularly, a lower space of the seal cap 50) rises. Here, the second hole 33 is provided to allow air to escape from the space between the stem 70 and the seal cap 50 to the container main body 10. When the pressure in the inner space of the housing 30 becomes sufficiently high, the second elastic member 71 may be compressed, and the space between the stem 70 and the seal cap 50 may be compressed.

The cylinder 40 moves up and down inside the housing 30 and has an inlet port 41 formed at one side. The cylinder 40 has an upper side coupled to the stem 70 so that the cylinder 40 moves up and down integrally with the stem 70. Since the stem 70 moves downward due to the button 60, when the button 60 is pressed, the cylinder 40 moves downward inside the housing 30.

One or more inlet ports 41 are provided at an outer surface of the cylinder 40, and the inlet ports 41 are provided to be isolated from the inner space of the housing 30 by the seal cap 50. However, when the pressure in the inner space of the housing 30 rises, the second elastic member 71 is compressed, and the seal cap 50 moves upward with respect to the cylinder 40, the inlet ports 41 may be opened, and the contents in the housing 30 may rapidly enter the cylinder 40.

In the cylinder 40, an annular frame 42 may be provided below the inlet port 41 so that the seal cap 50 is supported. That is, downward movement of the seal cap 50 may be limited as the seal cap 50 is caught at the annular frame 42 of the cylinder 40, and an inner surface of the seal cap 50 may maintain a state of being pressed against the outer surface of the cylinder 40. An upper end of the first elastic member 43 may be supported by the annular frame 42 of the cylinder 40, and a lower end of the first elastic member 43 may be supported by the step inside the housing 30. Therefore, the cylinder 40 may move downward due to the button 60 being pressed and may move upward due to an elastic force of the first elastic member 43, which is provided between the cylinder 40 and the housing 30 and has an elastic force that causes the cylinder 40 to move upward.

The seal cap 50 moves up and down inside the housing 30 and opens or closes the inlet port 41 while being pressed against the inner wall of the housing 30. The seal cap 50 may be supported by the annular frame 42 of the cylinder 40 and seal the inlet port 41 and then may be pushed upward by the pressure in the inner space of the housing 30, spaced apart from the annular frame 42 of the cylinder 40 due to moving upward, and open the inlet port 41.

A valve (not denoted by a reference numeral) is provided at a circumference of the seal cap 50 and maintains a state of being pressed against the inner wall of the housing 30, and an upper side of the seal cap 50 is provided to support a lower end of the second elastic member 71. Since the seal cap 50 receives an elastic force in a direction in which the seal cap 50 moves downward with respect to the stem 70 due to the second elastic member 71, and an upper end of the second elastic member 71 is supported by the stem 70, when the stem 70 moves downward due to the button 60 being pressed, the seal cap 50 also moves downward.

Here, while the suction port 31 is sealed by the ball 312 and the inlet port 41 is sealed by the seal cap 50, the downward movement of the seal cap 50 and the cylinder 40 causes the inner space of the housing 30 to be compressed, and thus the pressure in the inner space of the housing 30 rises.

However, when the pressure in the inner space of the housing 30 rises to an extent that the elastic force of the second elastic member 71 may be overcome, while the air in the space between the stem 70 and the seal cap 50 escapes into the container main body 10 through the second hole 33, the seal cap 50 may be pushed upward with respect to the cylinder 40 and the second elastic member 71 may be compressed.

When the contents exit the inner space of the housing 30 and the pressure therein is restored to its original state, the elastic force of the second elastic member 71 may cause the seal cap 50 to return to the position at which the seal cap 50 is supported by the annular frame 42 of the cylinder 40.

The button 60 has an outlet 611 and, when pressed, causes the cylinder 40 to move downward. The button 60 is coupled to the stem 70, and thus, when the button 60 is pressed, the cylinder 40 may move downward due to the stem 70, and, when a pressure applied to the button 60 is released, the cylinder 40 may move upward due to the first elastic member 43, the stem 70 may also move upward, and the button 60 may be restored to its original state.

Referring to FIG. 4, a flow path 61 configured to allow discharge of contents that exit the stem 70 may be provided inside the button 60, a front end of the flow path 61 may be designated as the outlet 611, and, for insertion of a nozzle 62 or the like, the outlet 611 may have a shape in which a cross-sectional area expands. The nozzle 62 and the orifice 100 may be sequentially coupled to the outlet 611 and reduce and change a cross-sectional area of the flow path 61 so that the contents may be sprayed in an aerosol form.

The nozzle 62 is inserted into the outlet 611 and reduces the flow path 61. The nozzle 62 will be described in detail below with reference to FIG. 5.

Figure 5:
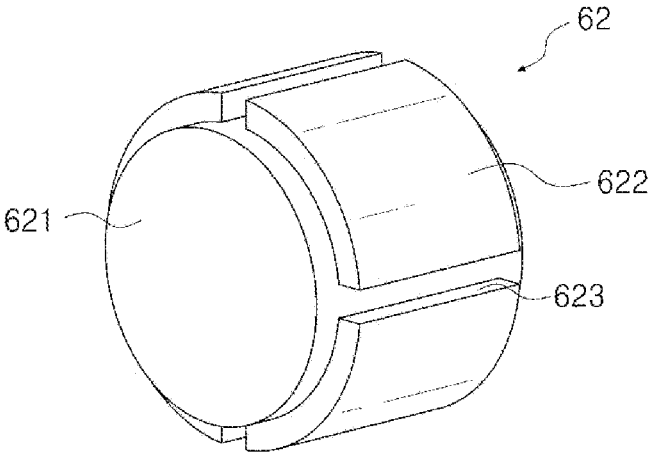
FIG. 5 is a perspective view of a nozzle of the spray container according to an embodiment of the present invention.

FIG. 5 is a perspective view of a nozzle of the spray container according to an embodiment of the present invention.

Referring to FIG. 5, the nozzle 62 has a cylindrical body 621 and arc-shaped protruding parts 622 which protrude from an outer surface of the body 621. Here, both a front surface and a rear surface of the body 621 may be blocked to prevent the contents from passing therethrough, and the protruding parts 622 may be provided to be spaced apart from each other on the outer surface of the body 621.

In this case, a gap 623 is formed between the protruding parts 622. The contents that enter the flow path 61 of the button 60 from the stem 70 may escape through the gap 623 of the nozzle 62 and be sprayed to the outside via the orifice 100.

The stem 70 connects the cylinder 40 and the button 60 and moves up and down together with the cylinder 40 while being pressed against the inner wall of the housing 30. The stem 70 may have a hollow shape. The cylinder 40 may be forcibly fitted into the stem 70, and the stem 70 may move up and down together with the cylinder 40.

As in the seal cap 50, a valve may be provided at an outer surface of the stem 70 and pressed against the inner wall of the housing 30. Therefore, the space between the stem 70 and the seal cap 50 may be isolated from the top or bottom.

However, the space between the stem 70 and the seal cap 50 may communicate with the inner portion of the container main body 10 through the second hole that has been described above, and, in this way, the space between the stem 70 and the seal cap 50 may be reduced.

The upper end of the second elastic member 71 may be supported by the valve of the stem 70, and a lower end of the second elastic member 71 may be supported by the upper side of the seal cap 50. Therefore, since the second elastic member 71 is provided between the stem 70 and the seal cap 50 and has an elastic force that causes the seal cap 50 to move downward with respect to the stem 70, during downward movement of the stem 70, the seal cap 50 may also move downward simultaneously due to the second elastic member 71.

However, since the seal cap 50 that moves downward is not structurally integrated with the stem 70, when the pressure in the inner space of the housing 30 becomes higher than the elastic force of the second elastic member 71, the seal cap 50 moves upward with respect to the cylinder 40 without moving downward despite the downward movement of the stem 70 and the cylinder 40, and the contents are discharged.

The under-cap 80 is coupled to the screw cap 11 or the housing 30 and wraps around the stem 70. The under-cap 80 may be provided to prevent foreign substances from entering between the stem 70 and the housing 30 but may allow air to enter the container main body 10 between the under-cap 80 and the stem 70.

After the contents are discharged to the outside, when the inner space of the housing 30 is filled with the contents from the container main body 10, the pressure inside the container main body 10 decreases. Here, air may enter the container main body 10 through the first hole 32 of the housing 30 via a gap between the under-cap 80 and the stem 70.

The orifice 100 is provided at the outlet 611 of the button 60 and allows the contents to be sprayed in an aerosol form. The orifice 100 will be described in detail below with reference to FIGS. 6 to 10.

Figure 6:
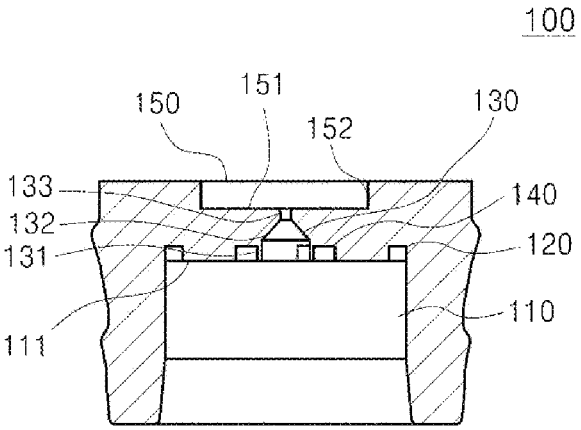
FIG. 6 is a cross-sectional view of an orifice of the spray container according to an embodiment of the present invention.
Figure 7:
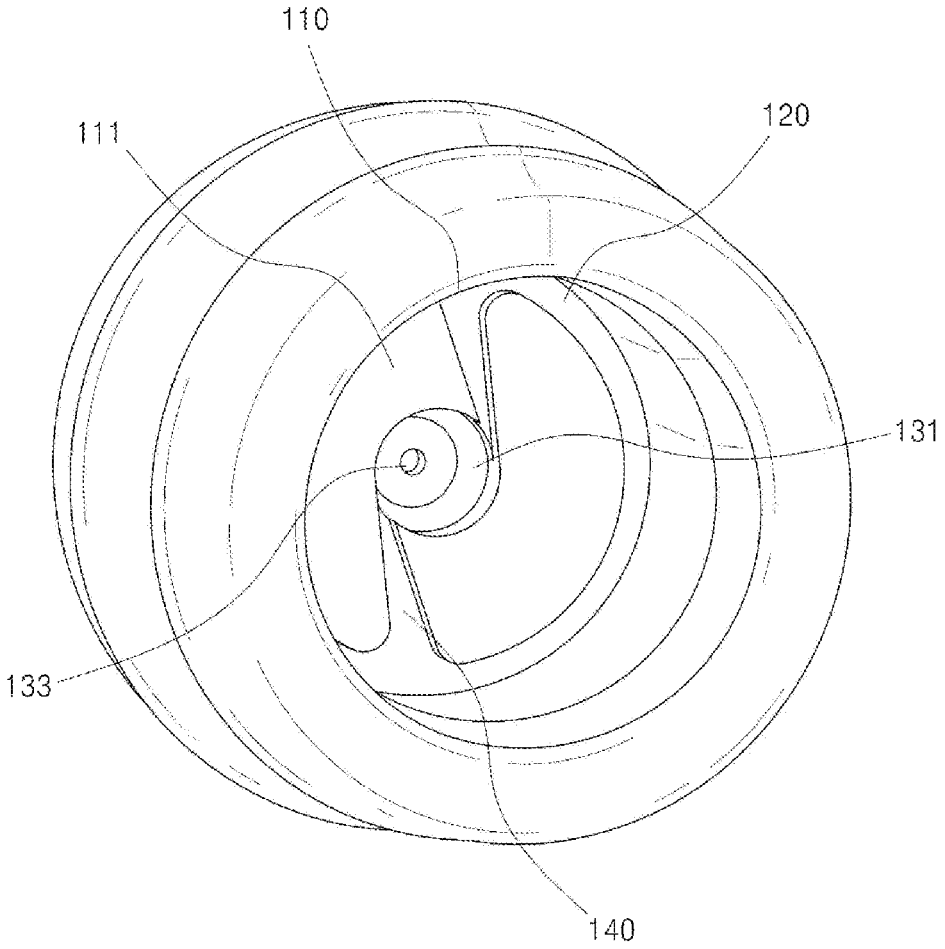
FIG. 7 is a perspective view of the orifice of the spray container according to an embodiment of the present invention.
Figure 8:
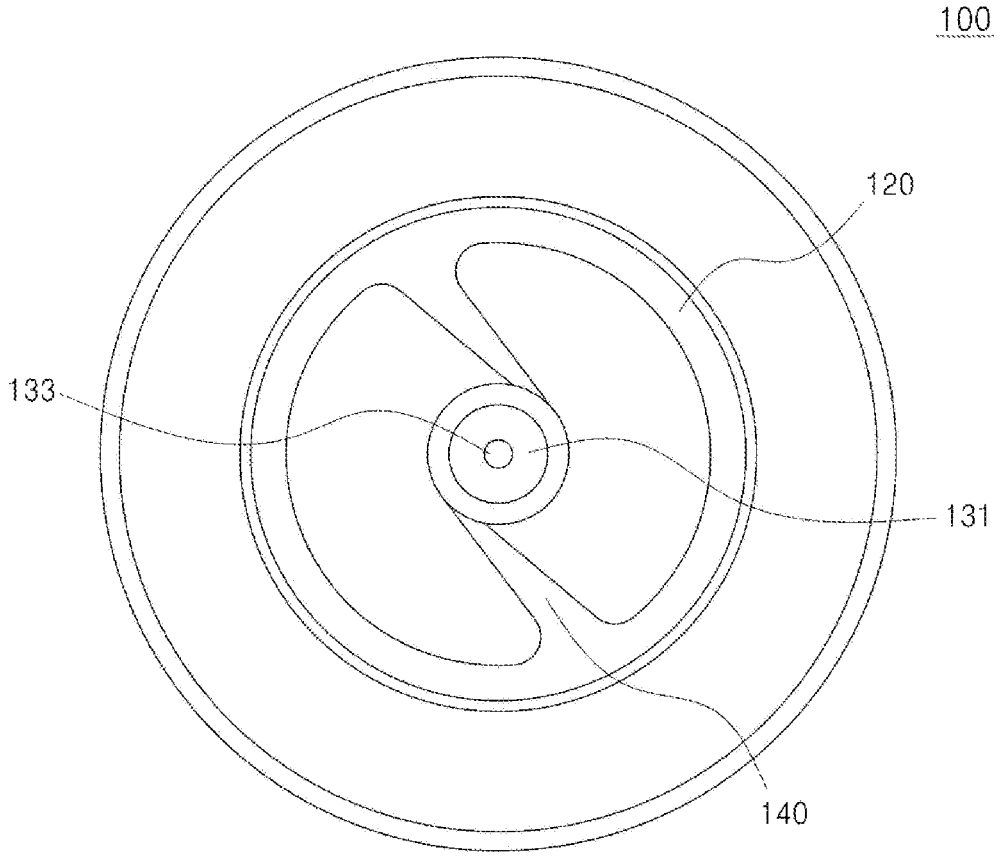
FIG. 8 is a front view of the orifice of the spray container according to an embodiment of the present invention.

FIG. 6 is a cross-sectional view of an orifice of the spray container according to an embodiment of the present invention, FIG. 7 is a perspective view of the orifice of the spray container according to an embodiment of the present invention, and FIG. 8 is a front view of the orifice of the spray container according to an embodiment of the present invention.

Referring to FIGS. 6 to 8, the orifice 100 has an outer surface formed in a shape (e.g., a corrugated shape or the like) that allows the orifice 100 to be pressed against an inner wall of the outlet 611 of the button 60. The orifice 100 may include an inflow part 110, a ring part 120, a discharge path 130, a wing part 140, and a discharge port 150.

The inflow part 110 has a hollow cylindrical shape into which the nozzle 62 is inserted, and contents enter the inflow part 110 through the circumference of the nozzle 62. Specifically, the inflow part 110 may have a shape formed by combining a truncated conical shape and a cylindrical shape, and an inner diameter of the inflow part 110 may decrease in a direction toward a front and then be maintained to be constant. An inner surface of the inflow part 110 may come in contact with an outer surface of the protruding part 622 provided at the nozzle 62 and may only allow the contents to flow through the gap 623 of the nozzle 62.

That is, the contents flow through a circumferential portion of the inflow part 110 that corresponds to the gap 623 and then are sprayed to the outside via the ring part 120 or the like formed at a front surface 111 of the inflow part 110.

The ring part 120 is recessed to a predetermined depth in a discharge direction from a circumference of the front surface 111 of the inflow part 110. The ring part 120 is a portion where the contents delivered through the gap 623 enter. The contents may be delivered to the discharge path 130 through the wing part 140 via the ring part 120.

The ring part 120 may have a depth that is 0.7 to 1.5 times a diameter of a small-diameter part 133 which will be described below. For example, when the diameter of the small-diameter part 133 is in a range of 0.15 to 0.25φ, the depth at which the ring part 120 is recessed may be in a range of 0.1 mm to 0.3 mm (preferably, 0.2 mm).

Also, the ring part 120 may have a depth that is 0.1 to 0.3 times a diameter of a large-diameter part 131 in the discharge path 130. For example, the diameter of the large-diameter part 131 may be 0.7φ and the depth of the ring part 120 may be 0.2 mm.

Also, the depth at which the ring part 120 is recessed may be 0.3 to 0.7 times a depth of the discharge port 150 which will be described below. For example, the depth of the discharge port 150 may be 0.4 mm and the depth of the ring part 120 may be 0.2 mm. Also, the depth at which the ring part 120 is recessed may be larger than a width of the wing part 140 which communicates with the large-diameter part 131. This will be described below.

The discharge path 130 is provided at a center of the ring part 120 and has a shape in which a cross-sectional area decreases in a direction toward a front. Specifically, the discharge path 130 may have the large-diameter part 131 in which a cross-sectional area is constant in a front-rear direction and the wing part 140, which will be described below, is connected to a circumference, a shaft tube part 132 which has a gradually-decreasing cross-sectional area while extending from the large-diameter part 131 to a front end, and the small-diameter part 133 in which a cross-sectional area is constant in the front-rear direction and which is connected to the front end of the shaft tube part 132 and connected to the discharge port 150 which will be described below.

The diameter of the large-diameter part 131 may be 2 to 5 times the diameter of the small-diameter part 133. For example, the diameter of the large-diameter part 131 may be 0.7φ, and the diameter of the small-diameter part 133 may be in a range of 0.15 to 0.25φ. Of course, numerical values of the diameters of the large-diameter part 131 and the small-diameter part 133 are not limited to the above and may be changed to various other numerical values as long as the contents may be sprayed smoothly.

A depth of the large-diameter part 131 in the front-rear direction may be larger than or equal to the depth of the ring part 120, and the depth of the ring part 120 may be equal to the depth of the wing part 140. Thus, the depth of the large-diameter part 131 may be larger than or equal to the depth of the wing part 140.

Heights of the shaft tube part 132 and the large-diameter part 131 may be similar, but a height of the small-diameter part 133 may be, for example, 0.3 to 0.7 times smaller than the height of the large-diameter part 131. However, the discharge path 130 may also be provided to basically include the shaft tube part 132 and not include at least either one of the large-diameter part 131 and the small-diameter part 133.

The wing part 140 extends from the ring part 120 toward the discharge path 130. The wing part 140 may be provided as a plurality of (preferably, two) wing parts 140 and may extend from the ring part 120 so as to come in contact with a circumference of the large-diameter part 131. That is, the wing part 140 may be provided in a shape extending toward an outer surface of the large-diameter part 131 instead of extending toward the center of the discharge path 130.

Therefore, the wing part 140 may be provided to be inclined at a predetermined angle with respect to a radial direction from the discharge path 130 toward the ring part 120.

The wing part 140 may have a shape in which a cross-sectional area decreases in a direction from one end connected to the ring part 120 to the other end connected to the discharge path 130. A width of a tip of the wing part 140 that communicates with the large-diameter part 131 may be smaller than the depth of the ring part 120 and, particularly, smaller than the diameter of the small-diameter part 133.

For example, when the diameter of the small-diameter part 133 is larger than or equal to 0.15φ, the width of the tip of the wing part 140 may have a numerical value around 0.14 mm, but the numerical value is not particularly limited thereto.

Figure 9:
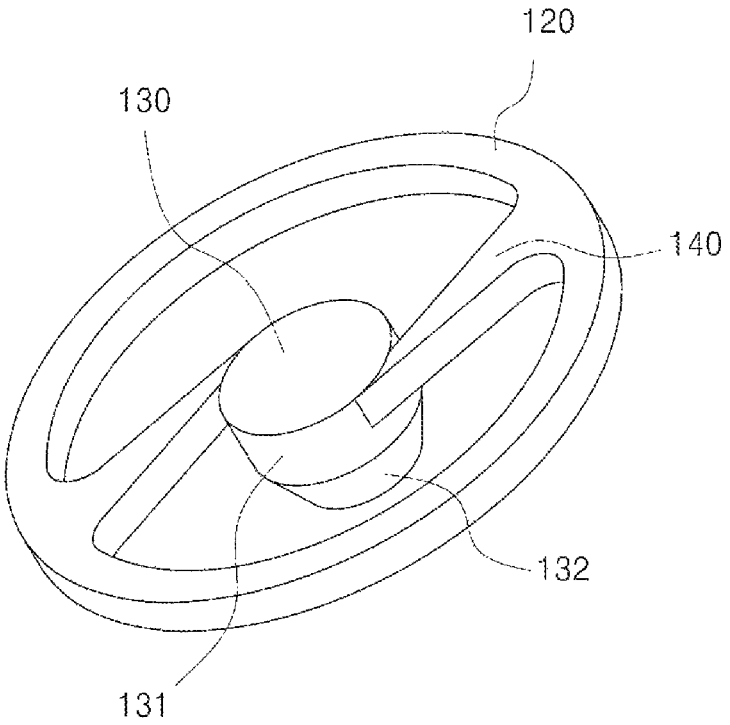
FIG. 9 is a perspective view showing a contents discharge path in an embossed form in the orifice of the spray container according to an embodiment of the present invention.

FIG. 9 is a perspective view showing a contents discharge path in an embossed form in the orifice of the spray container according to an embodiment of the present invention.

Referring to FIG. 9, after the contents enter the ring part 120 through the gap 623 of the nozzle 62, the contents may enter the large-diameter part 131 of the discharge path 130 along the wing part 140. Then, the contents may be sprayed from the large-diameter part 131 to the outside through the discharge port 150, which will be described below, via the shaft tube part 132 and the small-diameter part 133.

The discharge port 150 is a configuration provided at a front end of the discharge path 130. The discharge port 150 will be described in detail below with reference to FIG. 10.

Figure 10:
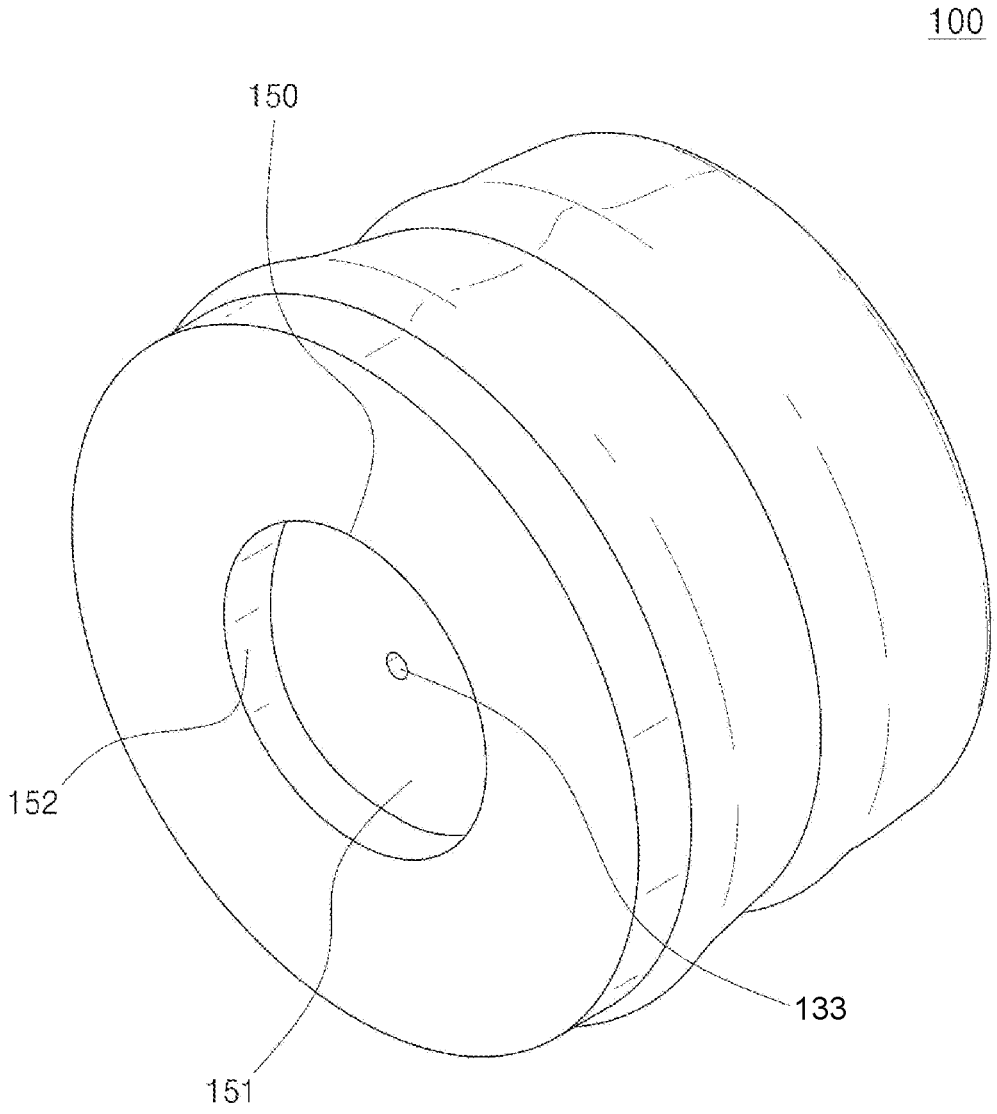
FIG. 10 is a rear perspective view of the orifice of the spray container according to an embodiment of the present invention.

FIG. 10 is a rear perspective view of the orifice of the spray container according to an embodiment of the present invention.

Referring to FIG. 10, the discharge port 150 may be provided at the front end of the discharge path 130 and have a flat rear surface 151. The discharge port 150 may have various shapes. For example, the discharge port 150 may have an arc shape or, instead of the arc shape, a shape in which the rear surface 151 is flat and a circumferential surface 152 is formed to be bent as compared to the rear surface 151.

The discharge port 150 according to an embodiment of the present invention may have a cylindrical shape in which, as compared to the rear surface 151, the circumferential surface 152 is perpendicularly bent. That is, the discharge port 150 has a cylindrical shape in which the rear surface 151 is flat instead of having a plate shape in which the rear surface 151 is convex rearward.

Here, a depth of the discharge port 150 in the front-rear direction may be larger than the depth of the ring part 120 and even larger than the depth of the large-diameter part 131. However, the depth of the discharge port 150 may be smaller than the overall depth of the discharge path 130.

For example, as mentioned above, the depth of the discharge port 150 may be 0.4 mm, which is about 2 times 0.2 mm, which is the depth of the ring part 120. Also, the depth of the discharge port 150 may be larger than the diameter of the small-diameter part 133 and may be formed to be about 1.5 to 3 times the diameter of the small-diameter part 133.

A cross-sectional area of the discharge port 150 may be smaller than the cross-sectional area of the inflow part 110 and larger than the cross-sectional area of the discharge path 130. Also, a diameter of the discharge port 150 may be around 2.5φ, which is 3 to 4 times the diameter of the large-diameter part 131 and 10 to 20 times the diameter of the small-diameter part 133.

According to the present invention, since the discharge port 150 has a cylindrical shape that is differentiated from conventional cylindrical shapes and a relatively large cross-sectional area is secured for the discharge port 150, the contents sprayed via the small-diameter part 133 may be prevented from being formed as droplets on the discharge port 150, and it is possible to address a conventional problem in that the droplets cause a user to mistakenly perceive that a leakage failure has occurred.

According to the present invention, it was confirmed through an experiment that, by improving specifications such as the shape and numerical values of the orifice as described above, a spray angle may be 40±10°, a discharge amount per one discharge may be 0.15±0.02 ml, and a spray distance may be secured to be about 80 cm or more.

This is confirmed to be due to narrowing the spray angle as compared to conventional cases, thus allowing fine particles to be sprayed far away. In this way, according to the present embodiment, when spraying contents on the user's skin or the like, the contents may be sprayed as fine particles, and thus the user's satisfaction may be maximized.

Hereinafter, a process of spraying using the spray container 1 according to an embodiment of the present invention will be described with reference to FIGS. 11 to 15.

Figure 11:
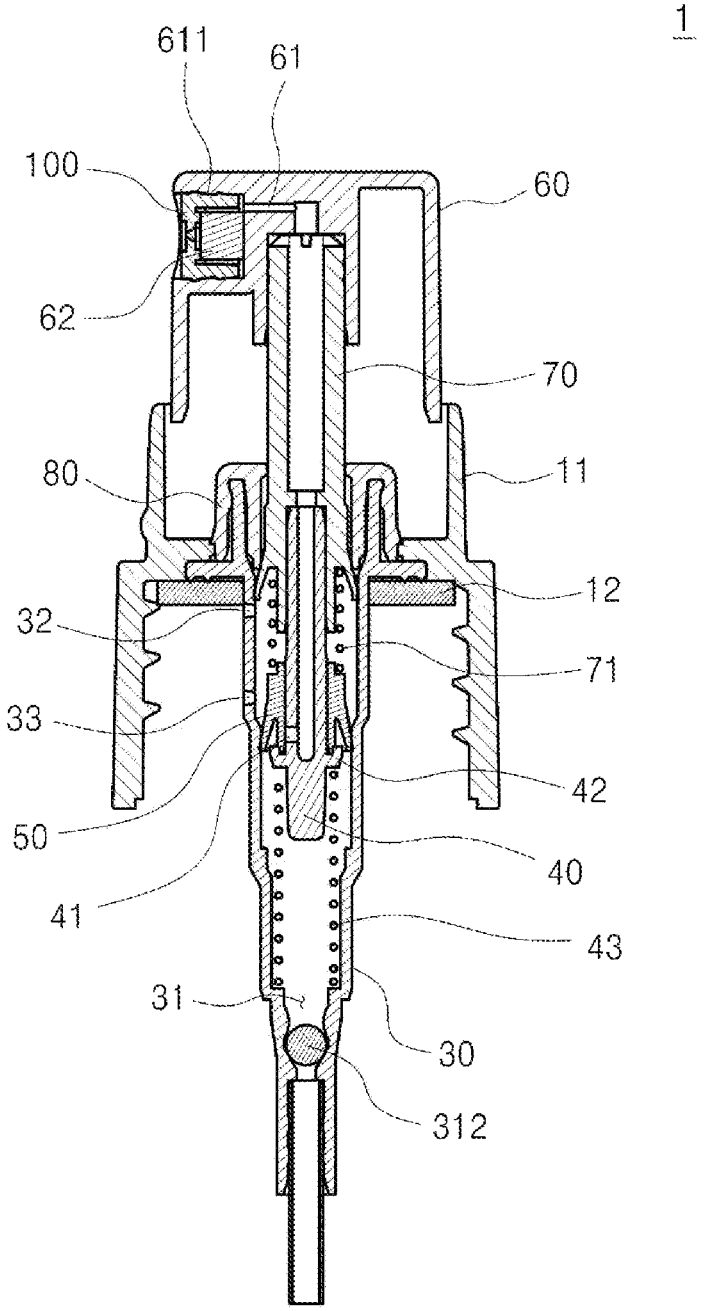
FIG. 11 is a cross-sectional view of the spray container according to an embodiment of the present invention.

FIG. 11 is a cross-sectional view (excluding the container main body 10) of the spray container according to an embodiment of the present invention and shows an initial state in which the button 60 is not pressed.

Referring to FIG. 11, in the state in which the button 60 is not pressed, the cylinder 40, the stem 70, and the button 60 are placed at the highest possible position due to the first elastic member 43, but the seal cap 50 is pushed downward from the stem 70 due to the second elastic member 71, comes in contact with the annular frame 42 of the cylinder 40, and seals the inlet port 41.

Figure 12:
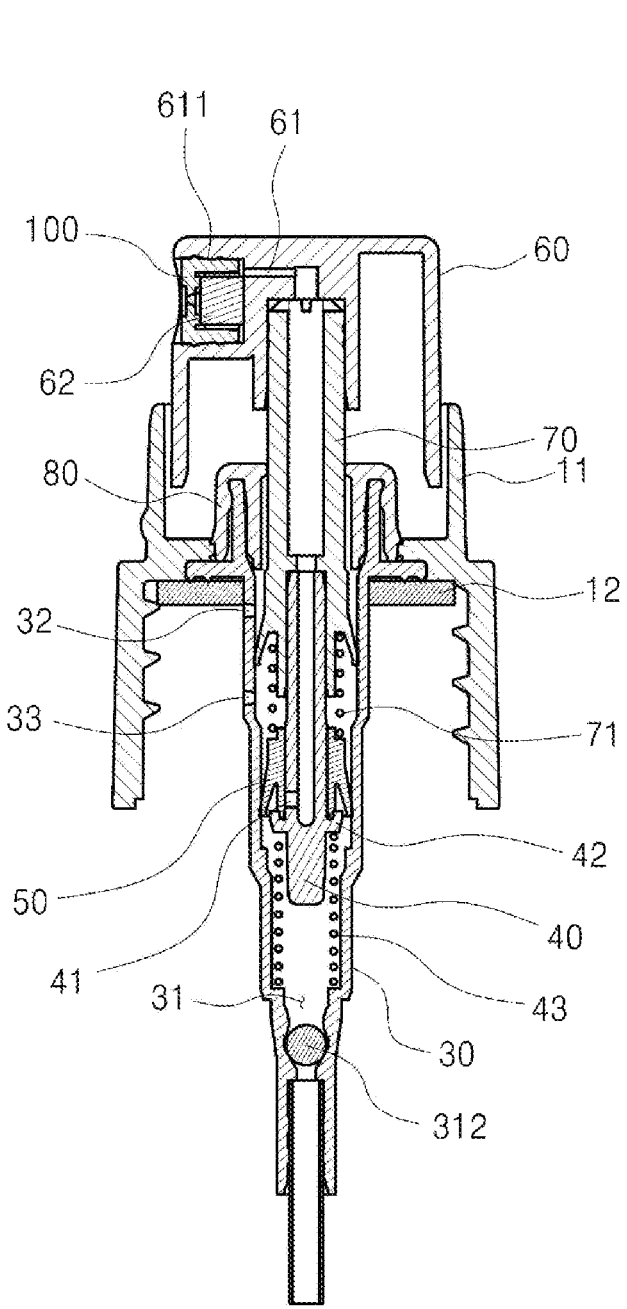
FIG. 12 is a cross-sectional view of the spray container according to an embodiment of the present invention.

FIG. 12 is a cross-sectional view (excluding the container main body 10) of the spray container according to an embodiment of the present invention and shows a state in which the button 60 is primarily pressed.

Referring to FIG. 12, when the button 60 is pressed and thus the stem 70 and the cylinder 40 move downward, the first elastic member 43 is compressed. In the case of the seal cap 50, even when the seal cap 50 is pressed against the inner wall of the housing 30, due to the second elastic member 71 whose upper end is supported by the stem 70, the seal cap 50 also moves downward while keeping the inlet port 41 of the cylinder 40 sealed.

In this case, due to the downward movement of the cylinder 40 and the seal cap 50, the volume of the inner space of the housing 30 that is below the cylinder 40 is reduced and the pressure therein rises.

Figure 13:
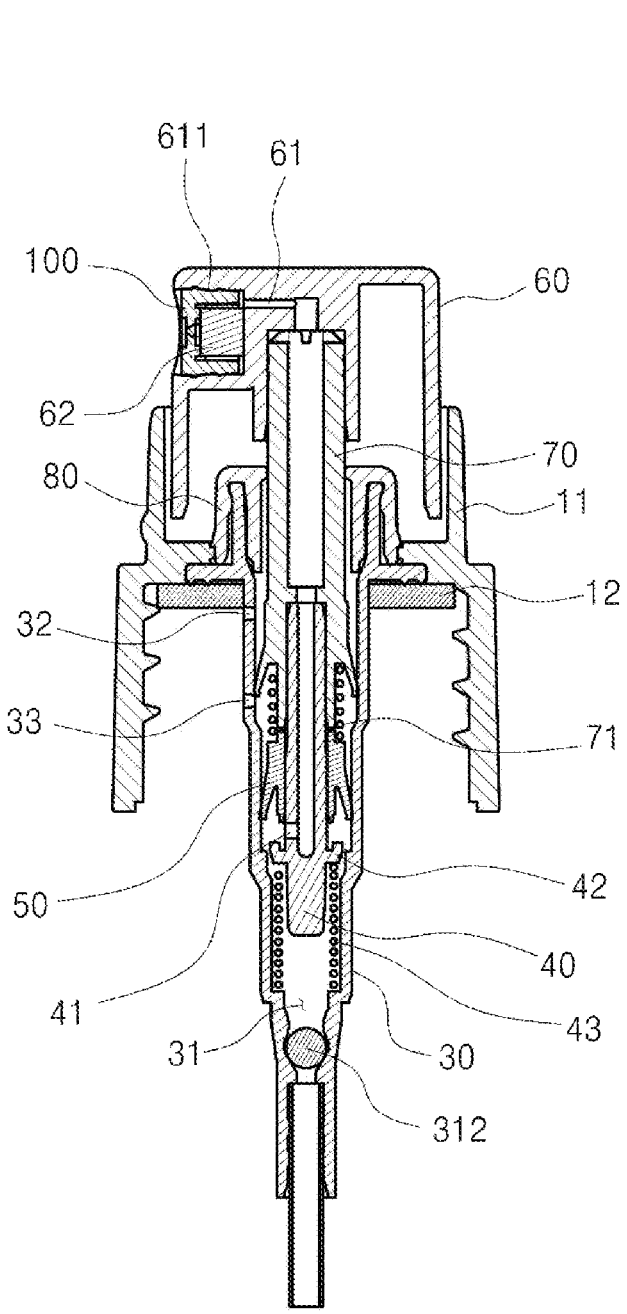
FIG. 13 is a cross-sectional view of the spray container according to an embodiment of the present invention.

FIG. 13 is a cross-sectional view (excluding the container main body 10) of the spray container according to an embodiment of the present invention and shows a state in which the button 60 is secondarily pressed.

Referring to FIG. 13, when the button 60 is pressed further, the pressure in the inner space of the housing 30 rises sufficiently and becomes higher than the elastic force of the second elastic member 71.

Therefore, due to the pressure in the inner space of the housing 30, the second elastic member 71 is compressed, and the seal cap 50 moves upward with respect to the cylinder 40. Thus, the cylinder 40 may be misaligned upward from the inlet port 41, and the inlet port 41 may be opened. Here, air in the space between the stem 70 and the seal cap 50 may enter the container main body 10 through the second hole 33.

Since the inner space of the housing 30 is already in a compressed state, when the inlet port 41 is opened, the contents may pass through the inner portion of the cylinder 40 and the inner portion of the stem 70 at a high speed and may be sprayed in an aerosol form to the outside through the nozzle 62 and the orifice 100 via the flow path 61 of the button 60.

Figure 14:
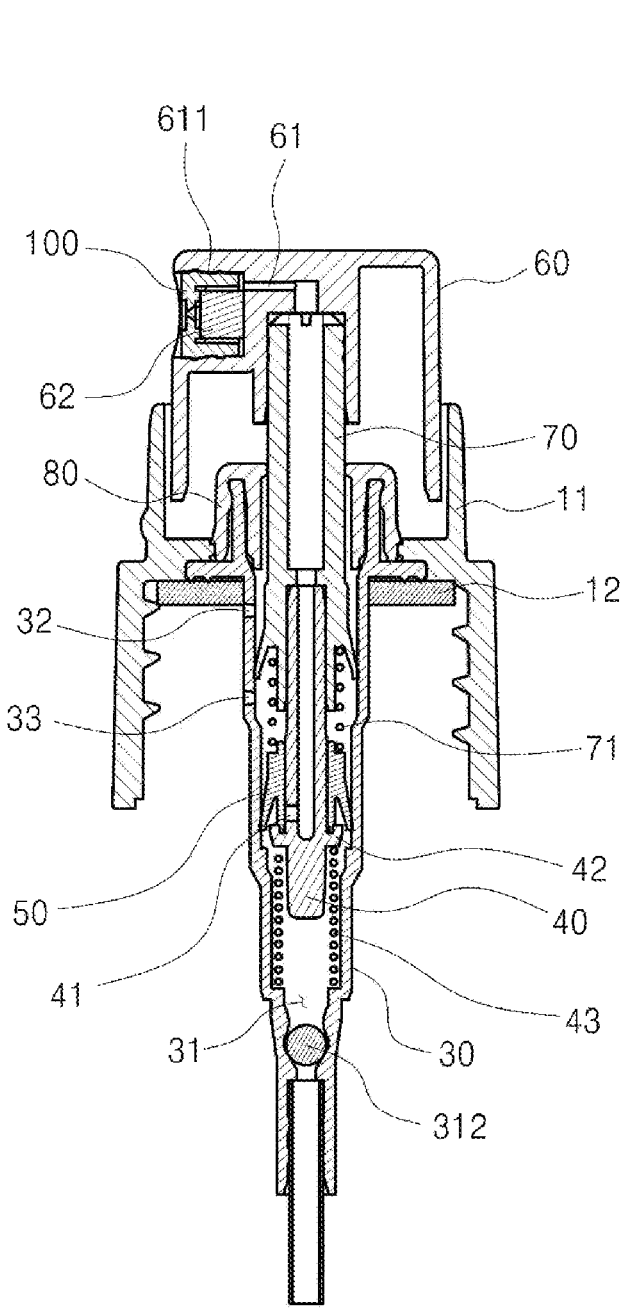
FIG. 14 is a cross-sectional view of the spray container according to an embodiment of the present invention.

FIG. 14 is a cross-sectional view (excluding the container main body 10) of the spray container according to an embodiment of the present invention and shows a state in which the pressure applied to the button 60 is primarily released.

Referring to FIG. 14, when pressing on the button 60 is released, the first elastic member 43 pushes the cylinder 40 upward, and since the pressure in the inner space of the housing 30 decreases due to the discharge of contents, the second elastic member 71 causes the seal cap 50 to move in a direction in which the seal cap 50 blocks the inlet port 41 again.

In this case, the seal cap 50 may receive an elastic force of the second elastic member 71 and move in a direction moving away from the stem 70 until the seal cap 50 is seated on the annular frame 42 of the cylinder 40, and air may enter the space between the stem 70 and the seal cap 50 through the second hole 33.

Figure 15:
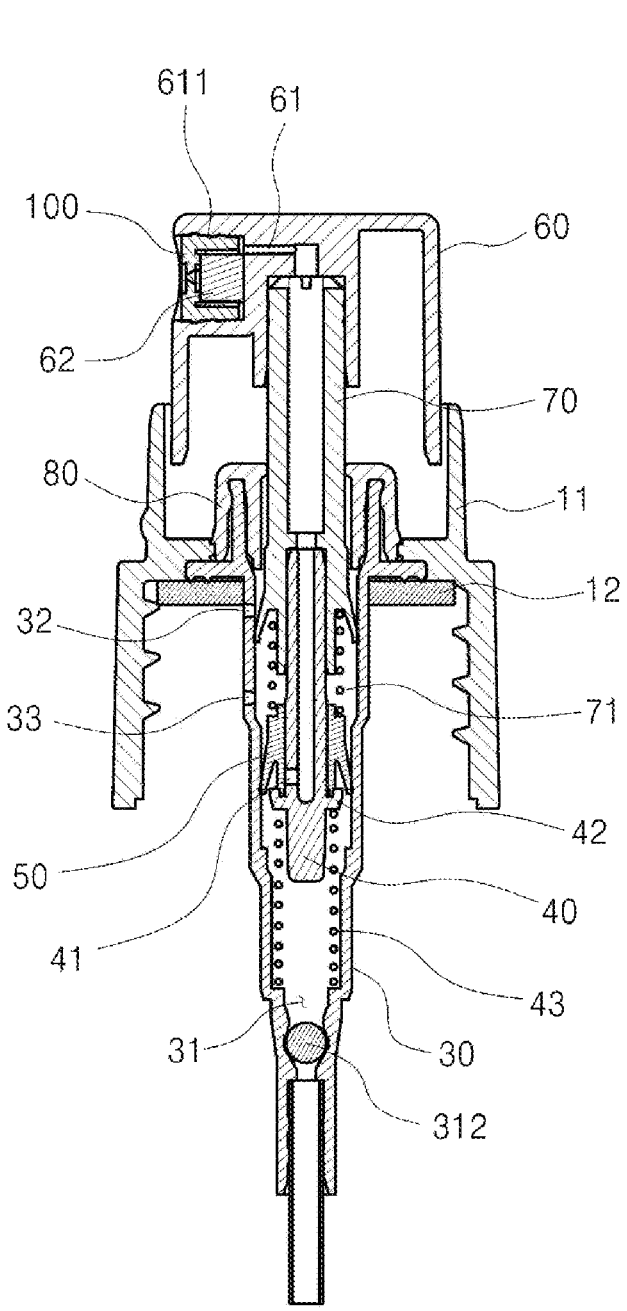
FIG. 15 is a cross-sectional view of the spray container according to an embodiment of the present invention.

FIG. 15 is a cross-sectional view (excluding the container main body 10) of the spray container according to an embodiment of the present invention and shows a state in which the pressure applied to the button 60 is secondarily released.

Referring to FIG. 15, when the first elastic member 43 further pushes the cylinder 40 upward, while the seal cap 50 is seated on the annular frame 42 of the cylinder 40, the seal cap 50 and the cylinder 40 move upward together, and the volume of the inner space of the housing 30 increases.

Here, due to a decrease in the pressure in the inner space of the housing 30, the ball 312 is naturally lifted, and the contents are drawn into the housing 30 through the suction port 31. Also, at the same time, in order to compensate for a decrease in the pressure that occurs as the contents exit the container main body 10, outside air may enter through the first hole 32 which is disposed above the valve of the stem 70.

Then, when the spray container 1 returns to the state illustrated in FIG. 11, the button 60 may be pressed again and the contents may be discharged.

The present invention has been described in detail above through specific embodiments, but the embodiments are for describing the present invention in detail and are not intended to limit the present invention. It should be apparent that the present invention may be modified or improved by those of ordinary skill in the art within the technical idea of the present invention.

Any simple modifications or changes to the present invention fall within the scope of the present invention, and the specific scope of the present invention should become clear by the claims below.

The invention claimed is:

1. An orifice provided at an outlet of a spray container, the orifice comprising:

an inflow part formed in a hollow cylindrical shape into which a nozzle is inserted and configured to receive contents flowing in through a circumference of the nozzle;

a ring part recessed to a predetermined depth in a discharge direction from a circumference of a front surface of the inflow part;

a discharge path provided at a center of the ring part and having a cross-sectional area decreasing in a direction toward a front;

a wing part extending from the ring part toward the discharge path; and a discharge port provided at a front end of the discharge path, wherein the discharge path comprises:

a large-diameter part in which a cross-sectional area is constant in a front-rear direction and the wing part is connected to a circumference;

a shaft tube part which has a gradually-decreasing cross-sectional area while extending from the large-diameter part to a front end; and a small-diameter part in which a cross-sectional area is constant in the front-rear direction and which is connected to the front end of the shaft tube part and connected to the discharge port.

2. The orifice of claim 1, wherein the wing part extends from the ring part so as to come in contact with a circumference of the discharge path.

3. The orifice of claim 1, wherein the wing part has a shape in which a cross-sectional area decreases in a direction from one end connected to the ring part to the other end connected to the discharge path.

4. The orifice of claim 1, wherein the discharge port includes a flat rear surface.

5. The orifice of claim 1, wherein a cross-sectional area of the discharge port is smaller than a cross-sectional area of the inflow part and larger than the cross-sectional area of the discharge path.

6. The orifice of claim 1, wherein the discharge port has a shape in which a circumferential surface is bent as compared to a rear surface.

7. The orifice of claim 1, wherein the discharge port is provided in a cylindrical shape.

8. A spray container comprising:

a container main body, of which one side is open, configured to accommodate contents;

a screw cap coupled to the open one side of the container main body;

a housing provided at an inner side of the screw cap and having a suction port formed at a lower end;

a cylinder configured to move up and down inside the housing and having an inlet port formed at one side;

a seal cap configured to move up and down inside the housing and open or close the inlet port while being pressed against an inner wall of the housing; and a button having an outlet, at which an orifice is provided, and configured to be pressed and cause the cylinder to move downward, wherein the orifice comprises:

an inflow part formed in a hollow cylindrical shape into which a nozzle is inserted and configured to receive the contents flowing in through a circumference of the nozzle;

a ring part recessed to a predetermined depth in a discharge direction from a circumference of a front surface of the inflow part;

a discharge path provided at a center of the ring part and having a cross-sectional area decreasing in a direction toward a front;

a wing part extending from the ring part toward the discharge path; and a discharge port provided at a front end of the discharge path, and wherein the discharge path comprises:

a large-diameter part in which a cross-sectional area is constant in a front-rear direction and the wing part is connected to a circumference;

a shaft tube part which has a gradually-decreasing cross-sectional area while extending from the large-diameter part to a front end; and a small-diameter part in which a cross-sectional area is constant in the front-rear direction and which is connected to the front end of the shaft tube part and connected to the discharge port.

9. The spray container of claim 8, further comprising:

a stem connecting the cylinder and the button and configured to move up and down together with the cylinder while being pressed against the inner wall of the housing;

an under-cap coupled to the screw cap or the housing and wrapping around the stem;

a first elastic member provided between the cylinder and the housing and having an elastic force that causes the cylinder to move upward; and a second elastic member provided between the stem and the seal cap and having an elastic force that causes the seal cap to move downward.

* * * * *